US011136830B2

(12) United States Patent
McDonough et al.

(10) Patent No.: US 11,136,830 B2
(45) Date of Patent: Oct. 5, 2021

(54) DOWNHOLE TOOLS WITH VARIABLE CUTTING ELEMENT ARRAYS

(71) Applicant: Smith International, Inc., Houston, TX (US)

(72) Inventors: Scott D. McDonough, The Woodlands, TX (US); Craig A. Raisanen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 313 days.

(21) Appl. No.: 16/271,908

(22) Filed: Feb. 11, 2019

(65) Prior Publication Data

US 2019/0249497 A1 Aug. 15, 2019

Related U.S. Application Data

(60) Provisional application No. 62/628,530, filed on Feb. 9, 2018.

(51) Int. Cl.

| | |
|---|---|
| ***E21B 10/16*** | (2006.01) |
| *E21B 10/52* | (2006.01) |
| *E21B 10/06* | (2006.01) |

(52) U.S. Cl.

CPC ..... *E21B 10/16* (2013.01); *E21B 10/06* (2013.01); *E21B 10/52* (2013.01)

(58) Field of Classification Search

CPC ..... E21B 10/06; E21B 10/16; E21B 10/52

See application file for complete search history.

(56) References Cited

U.S. PATENT DOCUMENTS

| | | | | |
|---|---|---|---|---|
| 4,940,099 | A | 7/1990 | Deane et al. | |
| 6,942,045 | B2 | 9/2005 | Dennis | |
| 7,370,711 | B2 | 5/2008 | Singh | |
| 7,686,104 | B2 | 3/2010 | Singh et al. | |
| 9,074,431 | B2 | 7/2015 | Portwood et al. | |
| 9,856,701 | B2 | 1/2018 | Portwood et al. | |
| 2009/0188724 | A1* | 7/2009 | Portwood | E21B 10/16 175/341 |
| 2018/0106113 | A1 | 4/2018 | McDonough et al. | |

* cited by examiner

*Primary Examiner* — Yong-Suk (Philip) Ro

(57) ABSTRACT

A downhole tool includes a cone with an outer surface, a cone axis, and a set on the outer surface thereof. The set includes first and second cutting elements. The first and second cutting elements have respective first and second grips that are different. Another downhole tool includes a body and a cone is connected to, and rotatable relative to, the body. Cutting elements on the cone are arranged in a set to vary in radial position relative to a cone axis, with a first position nearest to, and a last position farthest from, the cone axis. A first cutting element in the first position has a different cutting element geometry type than a second cutting element in the last position. First and second cutting elements may have the same cutting element geometry type and one or more cutting elements therebetween may have different cutting element geometry types.

20 Claims, 10 Drawing Sheets

DOWNHOLE TOOLS WITH VARIABLE CUTTING ELEMENT ARRAYS

CROSS-REFERENCE TO RELATED APPLICATIONS

This application claims the benefit of, and priority to, U.S. Patent Application No. 62/628,530, filed Feb. 9, 2018, which application is expressly incorporated herein by this reference.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

During drilling of a wellbore, cutting tools including cutting elements are used to remove material from the earth to extend the wellbore or from previous casing or lining of the wellbore to change the wellbore. The cutting tools experience wear during the cutting operations and cutting elements may loosen in the cutting tool. Lost cutting elements can damage the cutting tool and slow or stop work on the wellbore. Roller cone bits include cutting elements connected to a rotating cone on the cutting tool. Uniform cutting elements on the roller cone experience different amounts of wear related to the relative position of the cutting elements on the cone. Some cutting elements experience more wear and/or damage than other cutting elements, leading those elements to fail prematurely. A cutting tool with increased lifetime and improved reparability may reduce drilling system downtime.

SUMMARY

In some embodiments, a downhole tool includes a cone with an outer surface and a cone axis and a set positioned on the outer surface of the cone. The set includes a first cutting element and a second cutting element. The first cutting element has a first grip. The second cutting element has a second grip, where the second grip is different from the first grip.

In some embodiments, a downhole tool includes a body, a cone, and a plurality of cutting elements. The body has a bottom end and a longitudinal axis about which the body is configured to rotate. The cone is connected to the bottom end of the body and is rotatable relative to the body about a cone axis. The plurality of cutting elements is positioned on the cone and arranged in a set. The plurality of cutting elements varies in radial position relative to the cone axis and the set has a first position nearest the cone axis and a last position furthest the cone axis. A first cutting element is in the first position and a second cutting element is in the last position where the first cutting element and the second cutting element have a first cutting element geometry type. One or more cutting elements between the first cutting element and second cutting element have a second cutting element geometry type that is different from the first cutting element geometry type.

In some embodiments, a downhole tool includes a body, a cone, a first plurality of cutting elements, and a second plurality of cutting elements. The body has a bottom end and a longitudinal axis about which the body is configured to rotate. The cone is connected to the body at the bottom end and is rotatable relative to the body about a cone axis. The first plurality of cutting elements is positioned on the cone and arranged in a first set of an array and second plurality of cutting elements is positioned on the cone and arranged in a second set of the array. At least one of the cutting elements of the first plurality of cutting elements is positioned at a first longitudinal position relative to the cone axis and has a first cutting element geometry type. At least one of the cutting elements of the second plurality of cutting elements is positioned at the first longitudinal position relative to the cone axis and has a second cutting element geometry type that is different from the first cutting element geometry type.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure. Understanding that the drawings depict some example embodiments, the embodiments will be described and explained with additional specificity and detail through the use of the accompanying drawings in which:

FIG. 3-1 is a perspective view of a roller cone for a drill bit, according to some embodiments of the present disclosure;

FIG. 3-2 is a detail view of the roller cone of FIG. 3-1, according to some embodiments of the present disclosure;

FIG. 6-1 is a composite cutting profile of a roller cone, according to some embodiments of the present disclosure;

FIG. 6-2 is another composite cutting profile of a roller cone, according to some embodiments of the present disclosure;

DETAILED DESCRIPTION

This disclosure generally relates to devices, systems, and methods for increasing operational lifetime and decreasing downtime in a drill bit. More particularly, some embodiments of the present disclosure relate to devices, systems, and methods for positioning a set of cutting elements on a rotatable cone of a cutting tool, where the set includes a plurality of cutting elements with variable dimensions, properties, or geometry within the set.

In some embodiments, a cutting tool may have one or more cutting elements to remove material in a downhole environment. During cutting operations, the area at or near the radially outward gauge surface of a roller cone may experience high abrasion and/or erosion forces. A cutting tool according to some embodiments of the present disclosure may include one or more sets of cutting element within a spiral array of cutting elements on the roller cone. The spiral set may include cutting elements that vary in one or more of an extension, a diameter of the cutting element, a cutting element grip, a cutting element geometry type of the cutting element, a working material of the cutting element, or combinations thereof.

For example, a roller cone may include a set of cutting elements within an array where the cutting elements vary with greater extension near a bottommost portion of the cutting profile and lesser extension near a gauge surface of the cutting profile. In other examples, a roller cone may include a set with cutting elements that vary with greater diameter near a bottommost portion of the cutting profile and lesser extension near a gauge surface of the cutting profile. In yet other examples, a roller cone may include a set with cutting elements that vary with greater diameter near a bottommost portion of the cutting profile and lesser extension near a gauge surface of the cutting profile.

Figure 1:
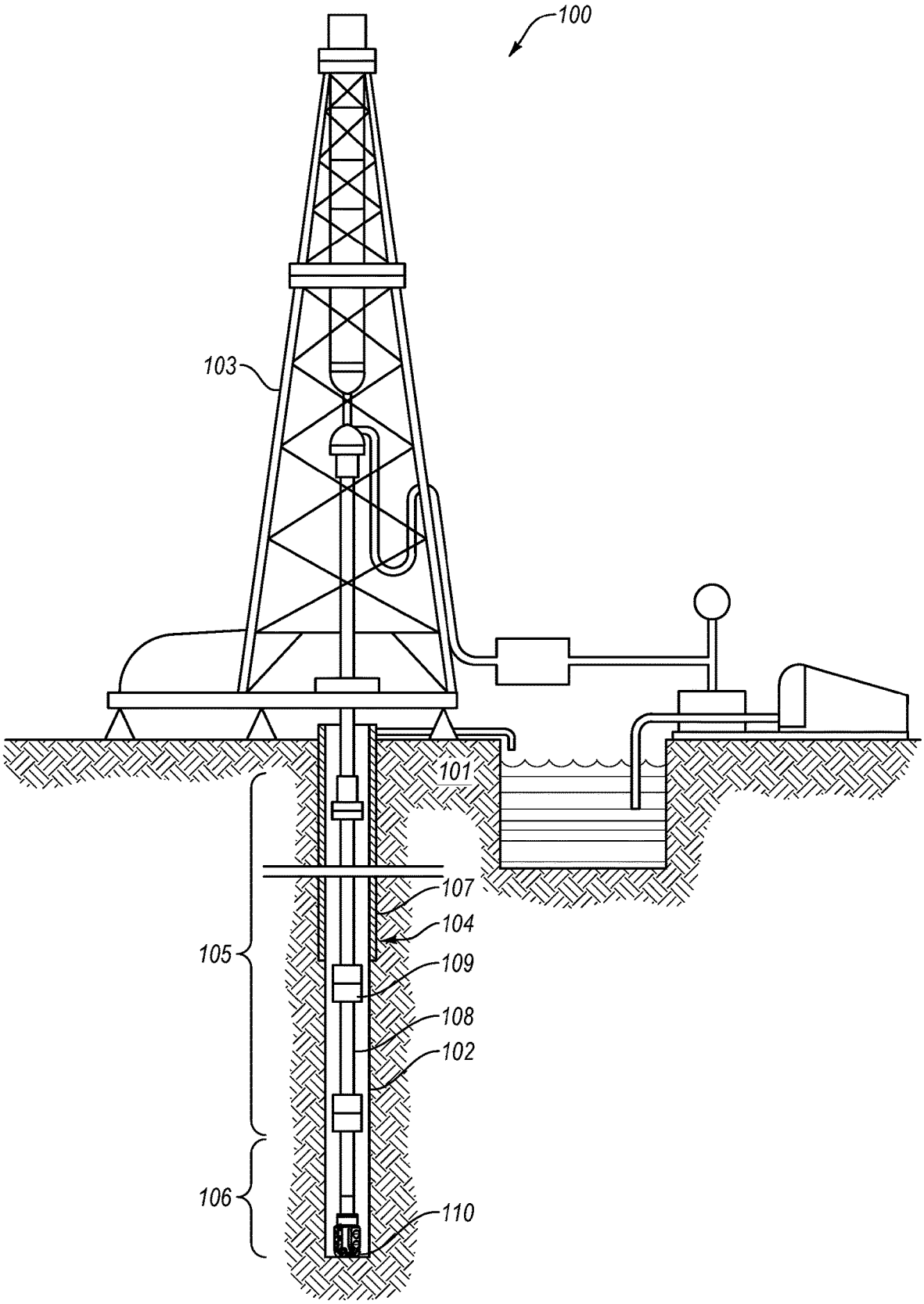
FIG. 1 is a side schematic view of a drilling system, according to some embodiments of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
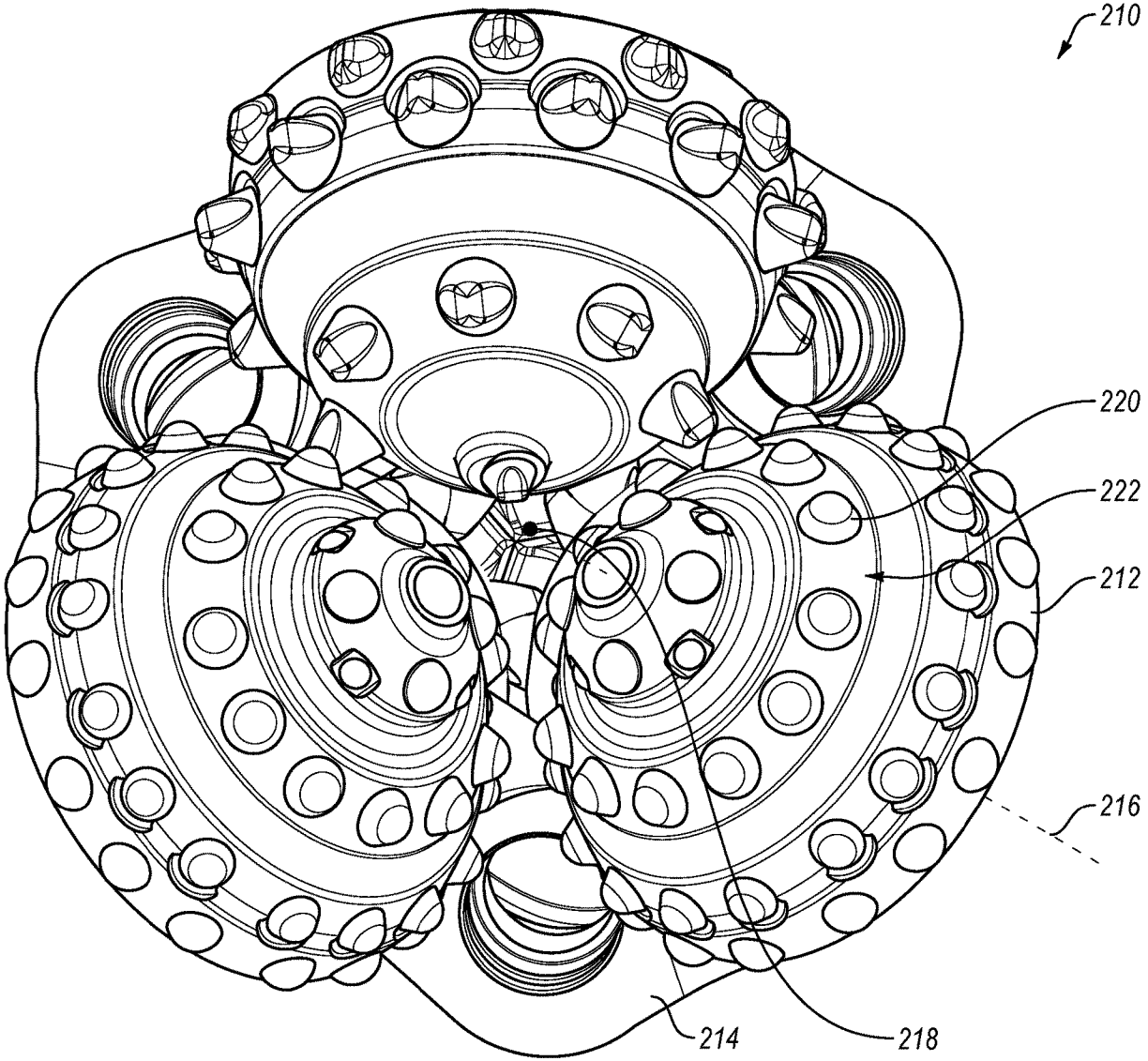
FIG. 2 is a bottom end view of a drill bit.

FIG. 2 is bottom end view of a conventional roller cone bit 210. A roller cone bit 210 may, generally, include one or more roller cones 212 connected to a body 214. The roller cones 212 are rotatably connected to the bottom end of the body 214 such that each roller cone 212 is rotatable about a cone axis 216. For instance, a journal or bearing may be used to rotatable connect the roller cones 212 to the body 214, or to a leg extending from the body 214. As the body 214 rotates about a longitudinal axis 218, contact between the roller cones 212 and a formation (such as formation 101 described in relation to FIG. 1) rotates the roller cones 212 about the cone axes 216.

The roller cones 212 may include a plurality of cutting elements 220. The cutting elements 220 continually strike the formation as the roller cones 212 rotate to fracture, break, degrade, or otherwise remove material from the formation to create a wellbore. In a conventional roller cone 212, the plurality of cutting elements 220 are arranged in rows 222. Each row 222 is positioned at a constant radial position relative to the cone axis 216 and around a circumference of the roller cone 212. The cutting elements 220 of each row 222 impact the formation sequentially to repeatedly strike the same area of the formation to remove material. The rows 222, however, can lead to the creation of ridges on either side of the eventual grooves formed in the formation that can reduce or limit the rate of penetration of the bit 210.

Figures 1, 3:
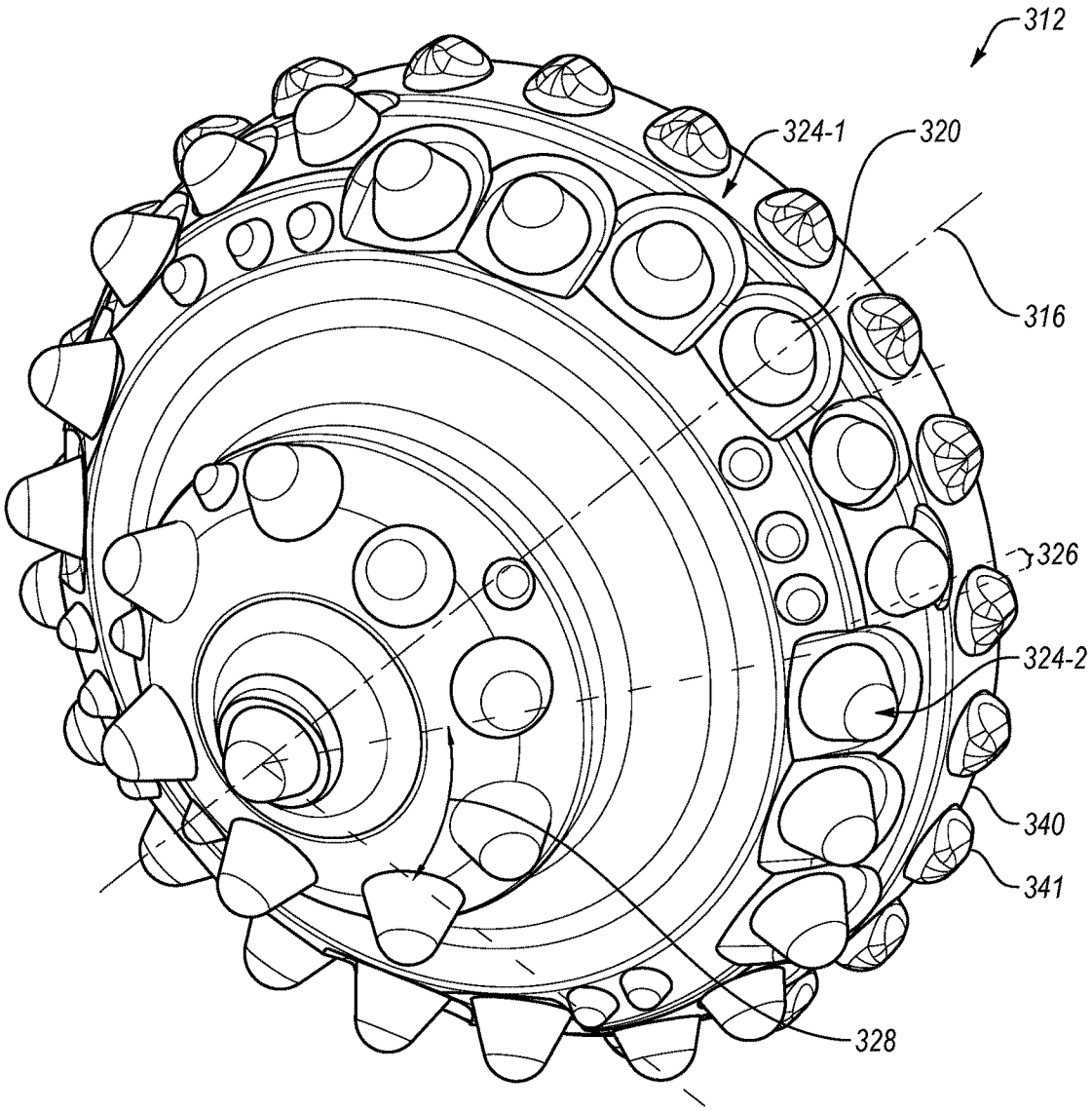
Figures 2, 3:
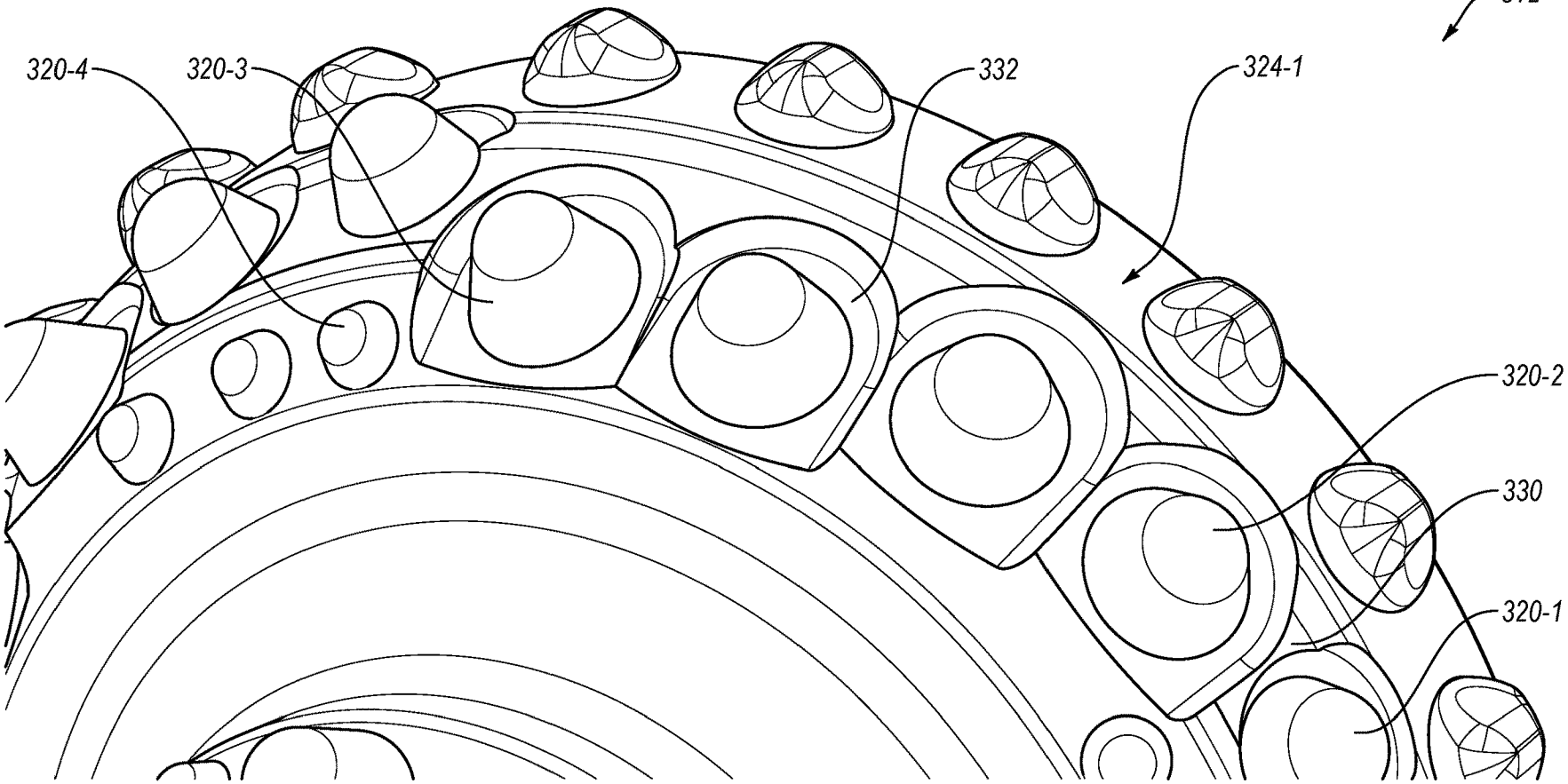

FIG. 3-1 is a perspective view of a roller cone 312, according to some embodiments of the present disclosure. The roller cone 312 may include a plurality of cutting elements 320 positioned in sets 324-1, 324-2 around a cone axis 316 where each set is oriented at a non-perpendicular angle to the cone axis 316. A sequence of sets 324-1, 324-2 may be contained in an array within a circumferential band about the cone axis 316. In some embodiments, a set 324-1, 324-2 may be positioned around the entire circumference of the roller cone 312 and/or may continue beyond a single full circumference. For example, a single set 324-1, 324-2 may spiral around the circumference of the roller cone 312 one or more times (e.g., greater than 360° around the cone axis 316). In other embodiments, a set 324-1, 324-2 may be positioned around a portion of the circumference of the roller cone 312, but less than a full circumference. For example, the set 324-1, 324-2 illustrated in FIG. 3-1 may be positioned around less than half, or approximately 120° of, the circumference of the roller cone 312 relative to the cone axis 316.

In some embodiments, a set 324-1, 324-2 may extend around a portion of the circumference in a range having an upper value, a lower value, or upper and lower values including any of 30°, 40°, 50°, 60°, 70°, 80°, 90°, 100°, 120°, 140°, 160°, 180°, 200°, 220°, 240°, 280°, 320°, 360°, or any values therebetween. In some examples, the set 324-1, 324-2 may be positioned around greater than 30° of the circumference of the roller cone 312. In other examples, the set 324-1, 324-2 may be positioned around less than 360° of the circumference of the roller cone 312. In yet other examples, the set 324-1, 324-2 may be positioned around between 30° and 360° of the circumference of the roller cone 312. In further examples, the set 324-1, 324-2 may be positioned around between 60° and 240° of the circumference of the roller cone 312. In yet further examples, the set 324-1, 324-2 may be positioned around between 90° and 180° of the circumference of the roller cone 312.

In some embodiments, a roller cone 312 may include rotationally overlapping sets 324-1, 324-2. For example, a first set 324-1 may spiral around a portion of the roller cone 312 in both an axial direction (i.e., in the direction of the cone axis 316) and a rotational direction (i.e., in the direction around the cone axis 316). A second set 324-2 may spiral around a portion of the roller cone 312 in both the axial direction and the rotational direction. A portion of the first set 324-1 and a portion of the second set 324-2 may rotationally overlap one another in the rotational direction relative to the cone axis 316 in an overlapping section 326.

In some embodiments, the overlapping section 326 may include a percentage of the set 324-1, 324-2 relative to a rotational length 328 of the set 324-1, 324-2. For example, in FIG. 3-1, the rotational length 328 of the second set 324-2 may be approximately 120° and the overlapping section 326 may be approximately 10° around the cone axis 316. The overlapping section 326 may be about 8% of the rotational length 328 of the second set 324-2. In some embodiments, the overlapping section 326 may be a percentage of the rotational length 328 of a set 324-1, 324-2 in a range having an upper value, a lower value, or an upper and lower value including any of 1%, 5%, 10%, 20%, 30%, 40%, 50%, 60%, 70%, 80%, 90%, or any values therebetween. In some examples, the overlapping section 326 may be greater than 1% of the rotational length 328 of a set 324-1, 324-2. In other examples, the overlapping section 326 may be less than 90% of the rotational length 328 of a set 324-1, 324-2. In yet other examples, the overlapping section 326 may be between 1% and 90% of the rotational length 328 of a set 324-1, 324-2. In further examples, the overlapping section 326 may be between 5% and 75% of the rotational length 328 of a set 324-1, 324-2. In yet further examples, the overlapping section 326 may be between 10% and 50% of the rotational length 328 of a set 324-1, 324-2.

In some embodiments, a set 324-1, 324-2 may include a series of cutting elements 320 that are substantially aligned in a spiral about the cone axis 316. It should be understood that one or more other cutting elements on the roller cone 312 may be aligned with a set, and not be considered part of the set. For example, the first set 324-1 includes a series of cutting elements 320 positioned in a spiral path in a rotational direction and longitudinal direction of the cone axis 316. The roller cone 312 may include a row of gauge cutting elements 341 positioned at or near a gauge surface 340 of the roller cone 312. In some embodiments, at least one gauge cutting element 341 in the row may be positioned in line with the spiral path of the first set 324-1. In such an example, the gauge cutting element 341 should be understood to be part of the row of gauge cutting elements adjacent the gauge surface 340, and should be understood to not be part of the first set 324-1.

Figure 5:
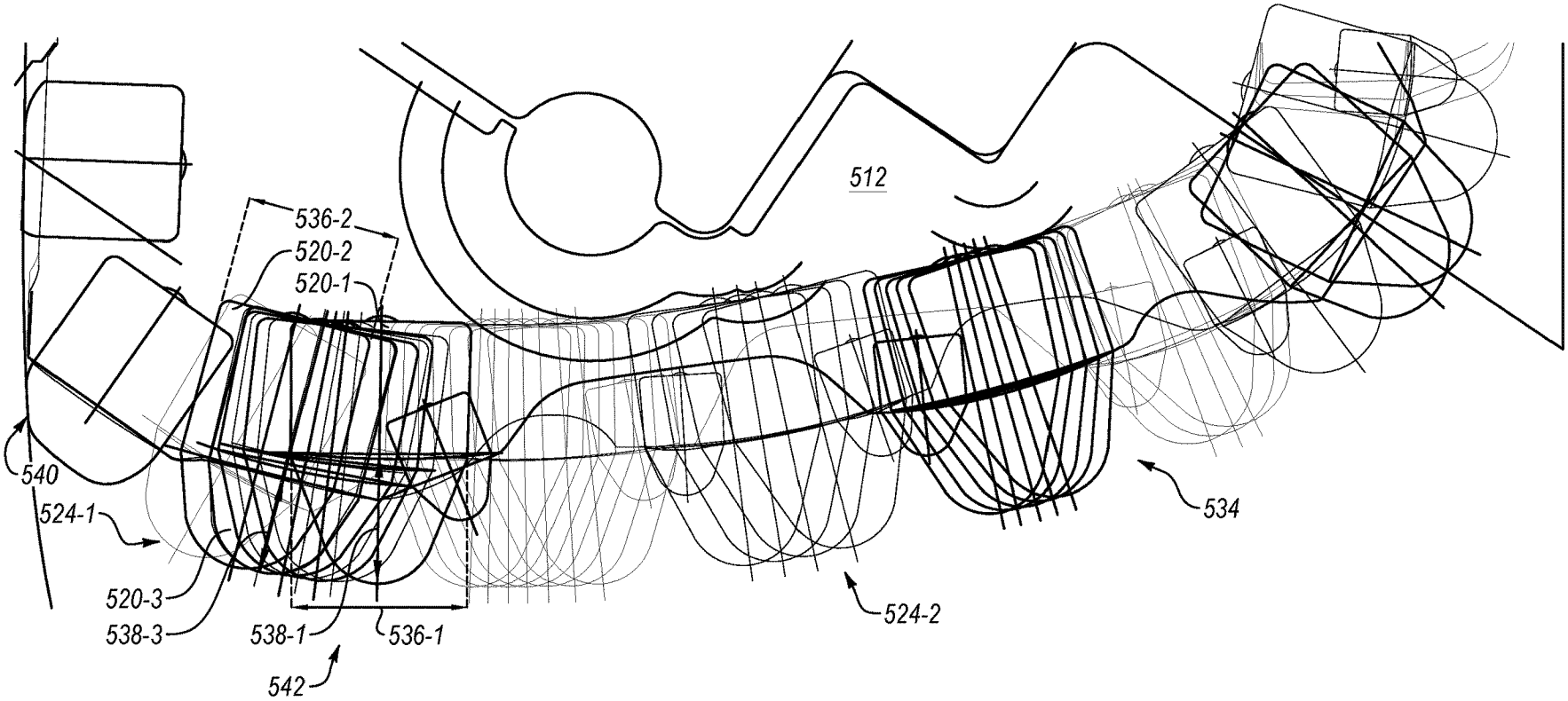
FIG. 5 is a composite cutting profile of a roller cone with a plurality of cutting elements in sets, according to some embodiments of the present disclosure.

FIG. 3-2 is a detail view of the first set 324-1 of the roller cone 312 of FIG. 3-1. In some embodiments, a set 324-1 may include a plurality of cutting elements 320-1, 320-2, 320-3. In at least one embodiment, one or more ridge cutting elements 320-4 may be positioned adjacent the set 324-1. The ridge cutting elements 320-4 may assist in breaking up any residual rock which was not cut by the cutting elements 320-1, 320-2, 320-3 of the set 324-1. In some embodiments, a set 324-1 may prevent such build-up of residual rock, and a roller cone 312 may include sets 324-1 without ridge cutting elements 320-4 adjacent the sets 324-1. Similar to the gauge cutting elements described in relation to FIG. 3-1, any ridge cutting elements 320-4 positioned on the roller cone 312 near or adjacent a set 324-1, should be understood to not be part of the set 324-1. For example, the ridge cutting elements 320-4 include cutting elements that are not part of the bottomhole composite cutting profile otherwise established by the cutting elements of the set 324-1. In other words, the ridge cutting elements 320-4 that are recessed from the composite cutting profile (such as shown in FIG. 5) are to be understood to not be part of the set 324-1. In other examples, the ridge cutting elements 320-4 may include cutting elements that are at least 15% recessed from the composite cutting profile relative to the extension of the immediately adjacent cutting element.

The cutting elements 320-1, 320-2, 320-3, may vary within the set 324-1. In an example, the first cutting element 320-1 and the second cutting element 320-2 may have different extensions above an outer surface 330. In other examples, a third cutting element 320-3 and a second cutting element 320-2 may have a different diameter to each other cutting element 320-1. The changes in cutting element diameter, cutting element extension, a working material of the cutting element, other changes to the geometry and/or cutting element geometry type of the cutting elements, or combinations thereof may allow for a cutting profile of the roller cone 312 that has a greater rate of penetration and lower risk of damage to the cutting elements 320-1, 320-2, 320-3.

In some embodiments, a portion of the working surface of the cutting element 320-1, 320-2, 320-3 may be recessed from the outer surface 330. For example, the embodiment of a first set 324-1 illustrated in FIG. 3-2 includes the first cutting element 320-1, the second cutting element 320-2, and the third cutting element 320-3 positioned in recesses 332. The recesses 332 may be located on the outer surface 330 of the roller cone 312. The extension of the cutting elements 320-1, 320-2, 320-3 positioned in the recess 332 may be relative to the surface of the recess 332 of the roller cone 312 as the recess 322 is part of the outer surface 330 of the roller cone 312. In some embodiments, varying recesses 332 may allow an extension of the cutting elements 320-1, 320-2, 320-3 to vary along the first set 324-1. In other embodiments, the recesses 332 may provide clearance around the cutting elements 320-1, 320-2, 320-3 during removal of material in operation of the roller cone bit.

Figure 4:
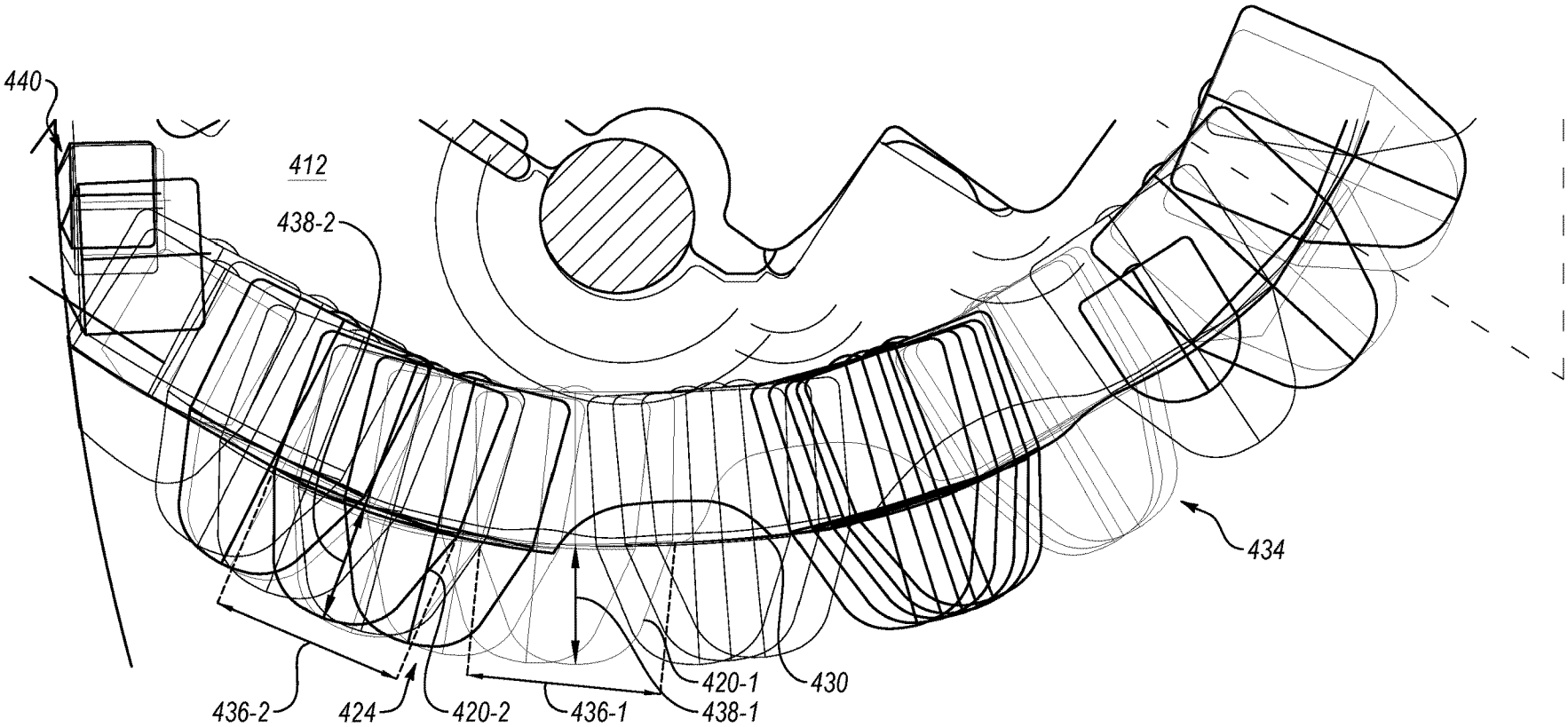
FIG. 4 is an example of a conventional composite cutting profile of a roller cone.

FIG. 4 illustrates an example of a composite cutting profile 434 of a conventional roller cone bit with conventional roller cones 412. The composite cutting profile 434 overlays the position of the cutting elements 420-1, 420-2 as the roller cones 412 rotate with the rotation of the roller cone bit. The composite cutting profile 434 therefore may illustrate the outline of the cutting elements 420-1, 420-2 positioned on the outer surface 430 of the roller cones 412 as experienced by the formation during rotation of the bit.

In a conventional composite cutting profile 434, the cutting elements 420-1, 420-2 may be substantially identical throughout the sets 424 and/or rows of the roller cone 412. For example, a first cutting element 420-1 of a set 424 may have a first diameter 436-1 and a first extension 438-1 beyond the outer surface 430 of the roller cones 412, and a second cutting element 420-2 of the set 424 may have a second diameter 436-2 and a second extension 438-2 beyond the outer surface 430 of the roller cones 412. The extension of a cutting element is the height along a longitudinal axis of the cutting element that protrudes above the surface of the roller cone immediately adjacent the cutting element.

In a conventional composite cutting profile 434, the first diameter 436-1 and the second diameter 436-2 may be approximately identical. In a conventional composite cutting profile 434, the first extension 438-1 and the second extension 438-2 may be approximately identical. Each of the cutting elements 420-1, 420-2 of the set 424 may be approximately identical with equal extensions, equal diameters, and the same working material composition throughout the composite cutting profile 434 toward the gauge surface 440. In some embodiments, the different forces experienced by the cutting elements 420-1, 420-2 may result in greater damage to those nearer the gauge surface 440.

FIG. 5 is a composite cutting profile 534 of roller cones 512 of a roller cone bit, according to some embodiments of the present disclosure. In some embodiments, the composite cutting profile 534 may include a plurality of arrays that each include one or more sets 524-1, 524-2. In some embodiment, at least the first sets 524-1 of the first array may include a variety of different cutting elements 520-1, 520-2, 520-3. For example, the first sets 524-1 may include a first cutting element 520-1 with a first diameter 536-1 and a second cutting element 520-2 with a second diameter 536-2. In some embodiments, the first diameter 536-1 may be greater than the second diameter 536-2. In other embodiments, the first diameter 536-1 may be less than the second diameter 536-2.

In some embodiments, at least one cutting element in the first sets 524-1 may have a diameter that is different from the diameter of another cutting element. For example, at least one cutting element may have a diameter that is a percentage of a diameter of another cutting element of the array in a range having an upper value, a lower value, or upper and lower values including any of 10%, 20%, 30%, 40%, 50%, 60%, 70%, 80%, 90%, 95%, or any values therebetween. For example, at least one cutting element may have a diameter that is greater than 10% of a diameter of another cutting element of the array. In other examples, at least one cutting element may have a diameter that is less than 95% of a diameter of another cutting element of the array. In yet other examples, at least one cutting element may have a diameter that is between 10% and 95% of a diameter of another cutting element of the array. In further examples, at least one cutting element may have a diameter that is between 20% and 90% of a diameter of another cutting element of the array. In yet further examples, at least one cutting element may have a diameter that is between 50% and 85% of a diameter of another cutting element of the array. In the embodiment of a composite cutting profile illustrated in FIG. 5, the second diameter 536-2 may be approximately 70% of the first diameter 536-1.

In some embodiments, the first set 524-1 may include a first cutting element 520-1 with a first extension 538-1 and a third cutting element 520-3 with a third extension 538-3. In some embodiments, the first extension 538-1 may be greater than the third extension 538-3. In other embodiments, the first extension 538-1 may be less than the third extension 538-3.

In some embodiments, at least one cutting element in the first sets 524-1 of the first array may have an extension that is different from an extension of another cutting element. For example, at least one cutting element may have an extension that is a percentage of an extension of another cutting element of the array in a range having an upper value, a lower value, or upper and lower values including any of 10%, 20%, 30%, 40%, 50%, 60%, 70%, 80%, 90%, 95%, or any values therebetween. For example, at least one cutting element may have an extension that is greater than 10% of an extension of another cutting element of the set. In other examples, at least one cutting element may have an extension that is less than 95% of an extension of another cutting element of the set. In yet other examples, at least one cutting element may have an extension that is between 10% and 95% of an extension of another cutting element of the set. In further examples, at least one cutting element may have an extension that is between 20% and 90% of an extension of another cutting element of the set. In yet further examples, at least one cutting element may have an extension that is between 30% and 85% of an extension of another cutting element of the set. In the embodiment of a composite cutting profile illustrated in FIG. 5, the third extension 538-3 may be approximately 75% of the first extension 538-1.

FIG. 5 illustrates a first array 524-1 with a plurality of cutting elements. In some embodiments, the cutting elements of a set of an array may have different cutting element geometry types. For example, the cutting elements may be non-planar cutting elements (i.e., apexed cutting elements). Apexed cutting element geometry types may include chisel cutting elements, such as cutting elements with an elongated axe-like leading edge or cutting tip; conical cutting elements, such as rotationally symmetrical cutting elements with at least a portion of the cutting element profile being angled and linear towards a center apex (such as the cutting elements 520-1, 520-2, 520-3 illustrated in FIG. 5); or curved cutting elements, such as a rotationally symmetrical "bullet" cutting element with a continuously curved working surface toward the center apex.

An array according to some embodiments of the present disclosure (such as array 524-1), may include a plurality of cutting elements with the same cutting element geometry type. For example, the set may include all non-planar cutting elements. In other examples, the set may include all conical cutting elements. In other embodiments, an array may include a plurality of cutting elements with different cutting element geometry types. For example, a set may include at least one conical cutting element and at least one bullet cutting element, at least one conical cutting element and at least one chisel cutting element, or at least one chisel cutting element and at least one bullet cutting element.

In some embodiments, a set of an array may include different cutting element geometries with the same cutting element geometry type. For example, a set of an array may include all conical cutting elements, where at least two of the conical cutting elements have differing radii of curvature at the apex, differing cone angles, differing diameters, or some combination of the foregoing. In other examples, a set of an array may include all chisel cutting elements, where at least two of the chisel cutting elements have differing radii of curvature at the apex, differing diameters, differing chamfer features, or the like. In yet other examples, a set of an array may include all chisel cutting elements, with at least two of the chisel cutting elements having differing widths of the cutting edge along the apex, differing diameters, or the like.

In some embodiments, a cutting element 520 may include a working material. For example, the working material may include a ceramic, carbide, diamond, or ultrahard material. An ultrahard material is understood to refer to those materials known in the art to have a grain hardness of about 1,500 HV (Vickers hardness in kg/mm2) or greater. Such ultrahard materials can include those capable of demonstrating physical stability at temperatures above about 750° C., and for certain applications above about 1,000° C., that are formed from consolidated materials. Such ultrahard materials can include but are not limited to diamond or polycrystalline diamond (PCD), nanopolycrystalline diamond (NPD), or hexagonal diamond (Lonsdaleite); cubic boron nitride (cBN); polycrystalline cBN (PcBN); Q-carbon; binderless PcBN; diamond-like carbon; boron suboxide; aluminum manganese boride; metal borides; boron carbon nitride; and other materials in the boron-nitrogen-carbon-oxygen system which have shown hardness values above 1,500 HV, as well as combinations of the above materials. In at least one embodiment, a portion of the cutting element 520 may be a monolithic carbonate PCD. For example, a portion of the cutting element 520 may consist of a PCD without an attached substrate or metal catalyst phase. In some embodiments, the ultrahard material may have a hardness values above 3,000 HV. In other embodiments, the ultrahard material may have a hardness value above 4,000 HV. In yet other embodiments, the ultrahard material may have a hardness value greater than 80 HRa (Rockwell hardness A).

In some embodiments, at least one set 524-1 of the first array may have cutting elements 520-1, 520-2, 520-3 with the same working materials. For example, all of the cutting elements of at least one set 524-1 of the first array may include the same working material. In at least one example, all of the cutting elements of at least one set 524-1 of the first array may include a PCD working material. In other embodiments, at least one set 524-1 of the first array may have cutting elements 520-1, 520-2, 520-3 with different working materials. For example, the first cutting element 520-1 may include a tungsten carbide working material and the second cutting element 520-2 may include a PcBN working material. In other examples, the first cutting element 520-1 may include a PcBN working material and the third cutting element 520-3 may include a PCD working material. In yet other examples, the first cutting element 520-1, second cutting element 520-2, and third cutting element 520-3 may each include different working materials from one another.

In some embodiments, roller cones 512 may include a plurality sets 524-1, 524-2 that form a plurality of arrays thereon. In some embodiments, each of the arrays may have cutting elements that vary in extension, diameter, working material, or combinations thereof. In other embodiments, at least one array, such as the second array 524-2 illustrated in FIG. 5, may include cutting elements that are identical in extension, diameter, and working material.

Figures 1, 6:
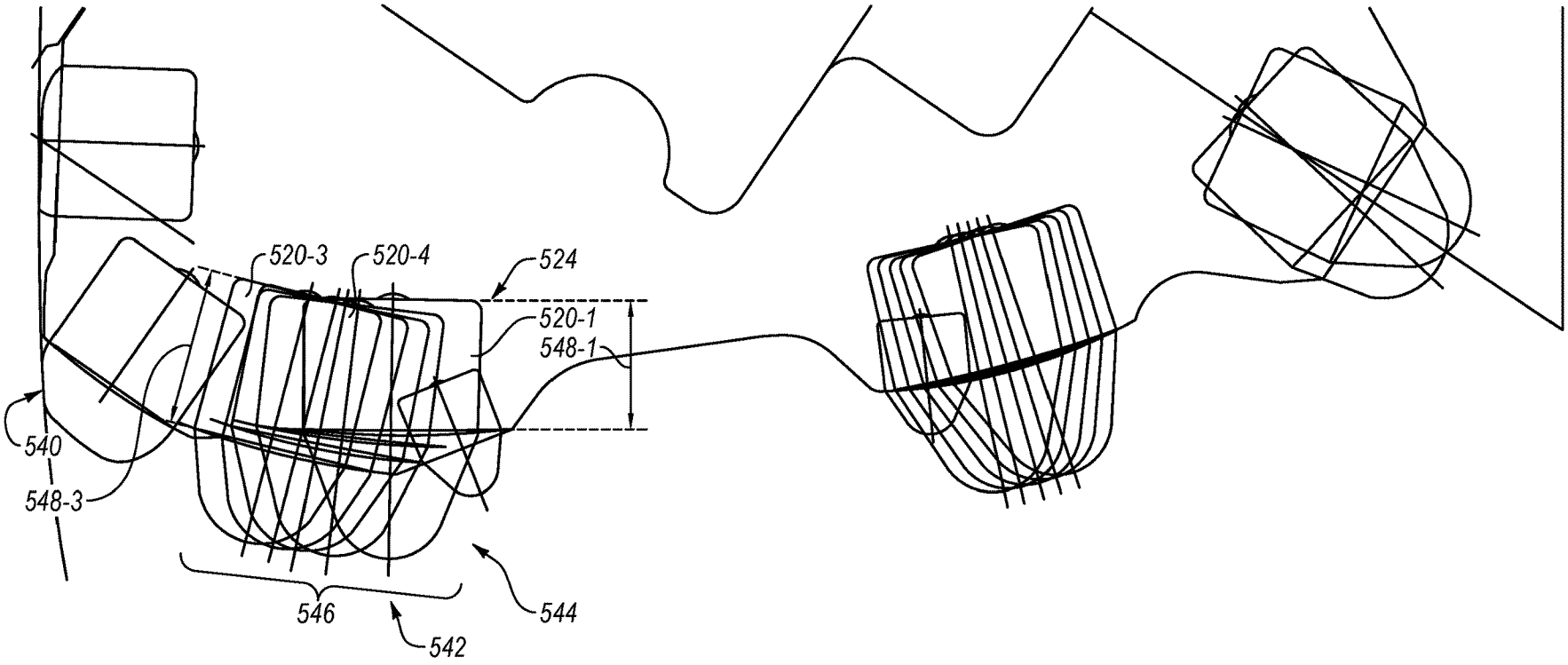
Figures 2, 6:
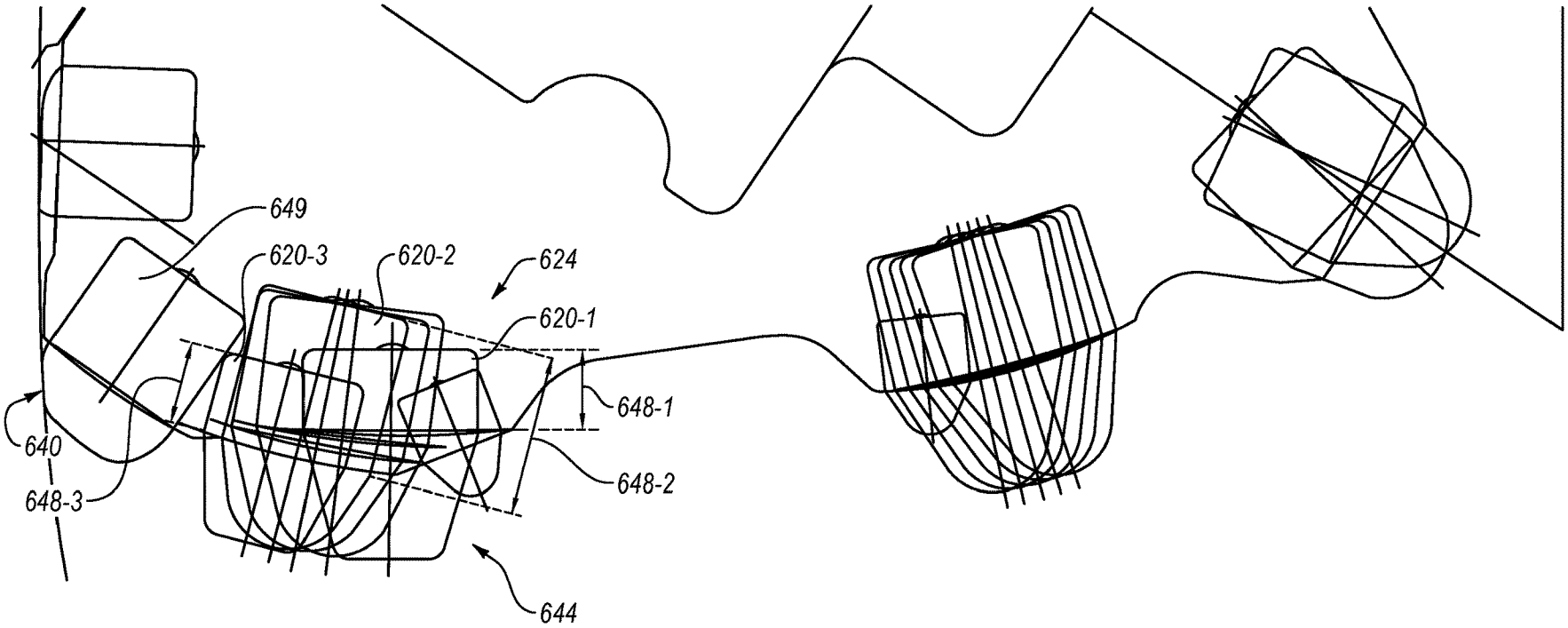

In some embodiments, at least one set 524-1 of an array may include a bottommost point 542 of the composite cutting profile 534 or bit, and the cutting elements of the set 524-1 may change relative to a proximity to the gauge surface 540. For example, FIG. 6-1 illustrates a first array composite cutting profile 544 of the cutting element sets 524 of the first array between the bottommost point 542 of the bit through a staggered zone 546 toward the gauge surface 540. The staggered zone 546 may be the area of the roller cone and/or composite cutting profile between the bottommost point 542 and the gauge surface 540.

In some embodiments, at least one cutting element in the sets 524 of the first array may have a cutting element grip that is different from a grip of another cutting element. Varying the grip may displace the bottom of each cutting element pocket, spacing stress risers from the cutting elements and/or cutting element pockets from one another. Varying the grip of different cutting elements in a set may allow for greater durability and impact resistance of the cutting element and/or cone body.

In some embodiments, at least one cutting element may have a grip that is a percentage of a grip of another cutting element of the set in a range having an upper value, a lower value, or upper and lower values including any of 50%, 60%, 70%, 80%, 90%, 95%, or any values therebetween. For example, at least one cutting element may have a grip that is greater than 50% of a grip of another cutting element of the set. In other examples, at least one cutting element may have a grip that is less than 95% of a grip of another cutting element of the set. In yet other examples, at least one cutting element may have a grip that is between 50% and 95% of a grip of another cutting element of the set. In further examples, at least one cutting element may have a grip that is between 60% and 90% of a grip of another cutting element of the set. In yet further examples, at least one cutting element may have a grip that is between 70% and 85% of a grip of another cutting element of the set. In the embodiment of a composite cutting profile illustrated in FIG. 6-1, the first grip 548-1 of the first cutting element 520-1 may be approximately 75% of the third grip 548-3 of the third cutting element 520-3.

In some embodiments, the grip may vary between cutting elements independently of the extension, diameter, cutting element geometry type, working material, or other property. For example, the grip may vary while the extensions are the same between the cutting elements. In other examples, the diameter may remain constant between cutting elements in a set while the grip varies. In yet other examples, a working material may be constant across cutting elements, while the grip of cutting elements may vary.

In some embodiments, extension, diameter, grip, working material, or combinations thereof of the cutting elements may change from the bottommost point 542 toward the gauge surface 540. For example, the first cutting element 520-1 may be positioned at or near the bottommost point 542 and the third cutting element 520-3 may be the cutting element of the sets 524 of the array closest to the gauge surface 540.

In some embodiments, a cutting element diameter may decrease from the cutting element at or nearest the bottommost point 542 to the cutting element at or nearest the gauge surface 540. For example, a diameter of the first cutting element 520-1 may be greater than a diameter of the third cutting element 520-3. In other embodiments, a cutting element diameter may increase from the cutting element at or nearest the bottommost point 542 to the cutting element at or nearest the gauge surface 540. For example, a diameter of the first cutting element 520-1 may be less than a diameter of the third cutting element 520-3.

In some embodiments, the change in cutting element diameter from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively smaller cutting element diameter. In other embodiments, the change in cutting element diameter from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same cutting element diameters. For example, the first cutting element 520-1 and the cutting element immediately adjacent in the direction of the gauge surface 540 may have the same cutting element diameter, while the third cutting element 520-3 may have a smaller cutting element diameter.

In some embodiments, the change in cutting element diameter from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively larger cutting element diameter. In other embodiments, the change in cutting element diameter from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same cutting element diameters. For example, the first cutting element 520-1 and the cutting element immediately adjacent in the direction of the gauge surface 540 may have the same cutting element diameter, while the third cutting element 520-3 may have a larger cutting element diameter.

In some embodiments, a cutting element extension may decrease from the cutting element at or nearest the bottommost point 542 to the cutting element at or nearest the gauge surface 540. For example, an extension of the first cutting element 520-1 may be greater than an extension of the third cutting element 520-3. In other embodiments, a cutting element extension may increase from the cutting element at or nearest the bottommost point 542 to the cutting element at or nearest the gauge surface 540. For example, an extension of the first cutting element 520-1 may be less than an extension of the third cutting element 520-3.

In some embodiments, the change in cutting element extension from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively smaller cutting element extension. In other embodiments, the change in cutting element extension from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same cutting element extensions. For example, the first cutting element 520-1 and the cutting element immediately adjacent in the direction of the gauge surface 540 may have the same cutting element extension, while the third cutting element 520-3 may have a smaller cutting element extension.

In some embodiments, the change in cutting element extension from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively larger cutting element extension. In other embodiments, the change in cutting element extension from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same cutting element extensions. For example, the first cutting element 520-1 and the cutting element immediately adjacent in the direction of the gauge surface 540 may have the same cutting element extension, while the third cutting element 520-3 may have a larger cutting element extension.

In some embodiments, a working material hardness of each cutting element may decrease from the cutting element at or nearest the bottommost point 542 to the cutting element at or nearest the gauge surface 540. For example, a working material hardness of the first cutting element 520-1 may be greater than a working material hardness of the third cutting element 520-3. In other embodiments, a working material hardness may increase from the cutting element at or nearest the bottommost point 542 to the cutting element at or nearest the gauge surface 540. For example, a working material hardness of the first cutting element 520-1 may be less than a working material hardness of the third cutting element 520-3.

In some embodiments, the change in working material hardness from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively lesser working material hardness. In other embodiments, the change in working material hardness from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same working material hardness. For example, the first cutting element 520-1 and the cutting element immediately adjacent in the direction of the gauge surface 540 may have the same working material hardness, while the third cutting element 520-3 may have a lesser working material hardness.

In some embodiments, the change in working material hardness from the cutting element at or nearest the bottommost point 542 to the cutting element at or nearest the gauge surface 540 may be continuous, with each cutting element from the cutting element at or nearest the bottommost point 542 toward the cutting element at or nearest the gauge surface 540 having a progressively greater working material hardness. In other embodiments, the change in working material hardness from the cutting element at or nearest the bottommost point 542 to the cutting element at or nearest the gauge surface 540 may be discrete, with at least two of the cutting elements between the cutting element at or nearest the bottommost point 542 to the cutting element at or nearest the gauge surface 540 having the same working material hardness. For example, the first cutting element 520-1 and the cutting element immediately adjacent in the direction of the gauge surface 540 may have the same working material hardness, while the third cutting element 520-3 may have a greater working material hardness.

FIG. 6-2 illustrates another composite cutting profile 644 of sets 624 comprising an array, according to some embodiments of the present disclosure. In some embodiments, the cutting elements at either end of the sets 624 of the array may have a different property and/or dimension that the cutting elements positioned between the ends of the sets 624. For example, the first cutting element 624-1 may be located in a first position of the set 624 nearest the cone axis and furthest from a gauge surface 640. At an opposite end of the set 624-1, the last position of the set 624 may have a cutting element with at least one property in common with the first cutting element and that is different from the one or more cutting elements positioned between. For example, the third cutting element 620-3 may be located in the last position and the second cutting element 620-2 may be positioned between the first cutting element 620-1 in the first position and the third cutting element 620-3 in the last position.

In some embodiments, the first cutting element 620-1 in the first position may have the same cutting element geometry type as the third cutting element 620-3 in the last position, while the one or more cutting elements located therebetween (e.g., the second cutting element 620-2) may have a different cutting element geometry type. For example, the first cutting element 620-1 in the first position and the third cutting element 620-3 in the last position may be chisel cutting elements, while the one or more cutting elements located therebetween (e.g., the second cutting element 620-2) may be conical cutting elements. In other embodiments, the first cutting element 620-1 in the first position may have the same grip as the third cutting element 620-3 in the last position, while the one or more cutting elements located therebetween (e.g., the second cutting element 620-2) may have a different grip. For example, the first grip 648-1 in the first position and the third grip 648-3 in the last position may be the same, while the one or more cutting elements located therebetween (e.g., the second cutting element 620-2) may have a longer grip. For example, the third grip 648-3 being lesser than other grips in the set 624 may provide additional clearance and/or spacing of stress risers from the row of gauge cutting elements 649 positioned at the gauge surface 640. In yet other embodiments, the first grip 648-1 in the first position and the third grip 648-3 in the last position may be greater than the grip of the one or more cutting elements located therebetween (e.g., the second cutting element 620-2).

In some embodiments, a grip ratio of the first grip 648-1 and third grip 648-3 to a grip of one or more cutting elements located therebetween may be in a range having an upper value, a lower value, or upper and lower values including any of 50%, 60%, 70%, 80%, 90%, 95%, or any values therebetween. For example, the first grip 648-1 and third grip 648-3 may be 0.5 inches (12.7 millimeters) and the grip of one or more cutting elements therebetween may be 1.0 inches (25.4 millimeters). In other examples, the grip ratio may be greater than 50%. In yet other examples, the grip ratio may be less than 95%.

In some embodiments, other dimensions and/or properties of the cutting elements in the first position and last position may be the same and may "bookend" a set with cutting elements having different dimensions and/or properties therebetween. For example, the first cutting element 620-1 in the first position may have the same extension as the third cutting element 620-3 in the last position, while the one or more cutting elements located therebetween (e.g., the second cutting element 620-2) may have a different extension. For example, the first cutting element 620-1 in the first position and the third cutting element 620-3 in the last position may have an extension that is less than that of the one or more cutting elements located therebetween (e.g., the second cutting element 620-2). Such a reduction in extension at ends of the set 624 may allow for a more gradual start to the set 624 contacting the material of the formation and may increase operational lifetime of the tool.

In other examples, the first cutting element 620-1 in the first position may have the same diameter as the third cutting element 620-3 in the last position, while the one or more cutting elements located therebetween (e.g., the second cutting element 620-2) may have a different diameter. For example, the first cutting element 620-1 in the first position and the third cutting element 620-3 in the last position may have a diameter that is less than that of the one or more cutting elements located therebetween (e.g., the second cutting element 620-2). Such as reduction in diameter at the ends of the set 624 may allow for closer packing of the cutting elements to adjacent features of the roller cone.

In yet other examples, the first cutting element 620-1 in the first position may have the same working material as the third cutting element 620-3 in the last position, while the one or more cutting elements located therebetween (e.g., the second cutting element 620-2) may have a different working material. For example, the first cutting element 620-1 in the first position and the third cutting element 620-3 in the last position may have a working material that is harder than that of the one or more cutting elements located therebetween (e.g., the second cutting element 620-2). The harder working material may allow the set 624 to resist erosion at the ends of the set 624, while enabling the use of cheaper and/or easier to manufacture working materials in the interior of the set 624.

Figure 7:
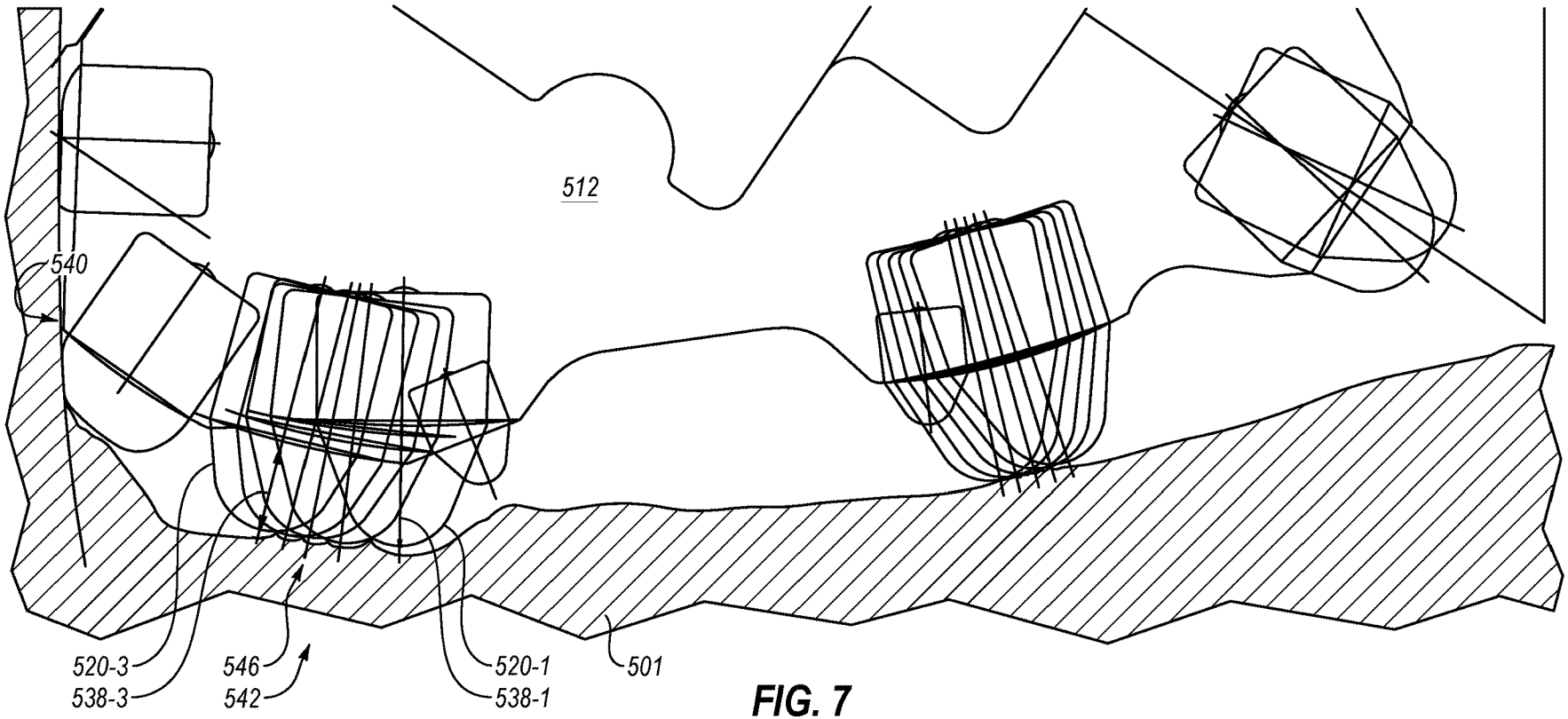
FIG. 7 is a schematic representation of the composite cutting profile of FIG. 6-1 removing material from an earth formation, according to some embodiments of the present disclosure.

FIG. 7 is a schematic representation of the roller cone 512 removing material from a formation 501, according to embodiments of the present disclosure. In some embodiments, a roller cone 512 may incur less damage and/or increase a rate of penetration with a set with different cutting elements. For example, cutting elements 520-1, 520-3 between the bottommost point 542 and gauge surface 540 of the roller cone 512 (i.e., in the staggered zone 546) may be different from one another to increase a rate of penetration of the first cutting element 520-1 at or near the bottommost point 542 while reducing damage to the third cutting element 520-3 at or near the gauge surface 540.

In some embodiments, a first cutting element 520-1 may be oriented more axially downhole (e.g., in the longitudinal direction of the roller cone bit) relative to the radially tilted third cutting element 520-3. The third cutting element 520-3 may experience greater forces and greater exposure to wear nearer the gauge surface 540 than the first cutting element 520-1. The third cutting element 520-3 may have a third extension 538-3 that is shorter than the first extension 538-1 of the first cutting element 520-1 to support the third cutting element 520-3. The first cutting element 520-1 may have a larger first extension 538-1, relative to third extension 538-3 of the third cutting element 520-3, that provides a greater rate of penetration of the roller cone 512.

In some embodiments, the first extension 538-1 may be the largest extension of the set. The first extension 538-1 may be relatively larger to provide a greater rate of penetration by creating unsupported formation 501. After contact with the first cutting element 520-1, the formation 501 may have a recess therein. The area of the formation 501 around the recess is unsupported (e.g., it may collapse toward the recess under force), and the cutting elements positioned in the staggered zone 546 may subsequently and in series, remove and propagate the unsupported material of the formation to remove material. The aggressive first cutting element 520-1 may allow for a deeper unsupported material, enabling a greater rate of penetration. The subsequent cutting elements after the first cutting element 520-1 (sequentially toward the gauge surface 540) may have less extension and/or may be less aggressive to reduce wear on the cutting elements while still removing the unsupported material.

In some embodiments, the first cutting element 520-1 may further have a larger diameter than subsequent cutting elements (toward the gauge surface 540). A greater extension may provide an increased rate of penetration relative to a lesser extension, and a larger diameter may further support a cutting element with a greater extension. Further, the cutting elements at or near the gauge surface 540 may have a smaller diameter to facilitate closer packing of cutting elements to increase wear and/or erosion resistance.

Figure 8:
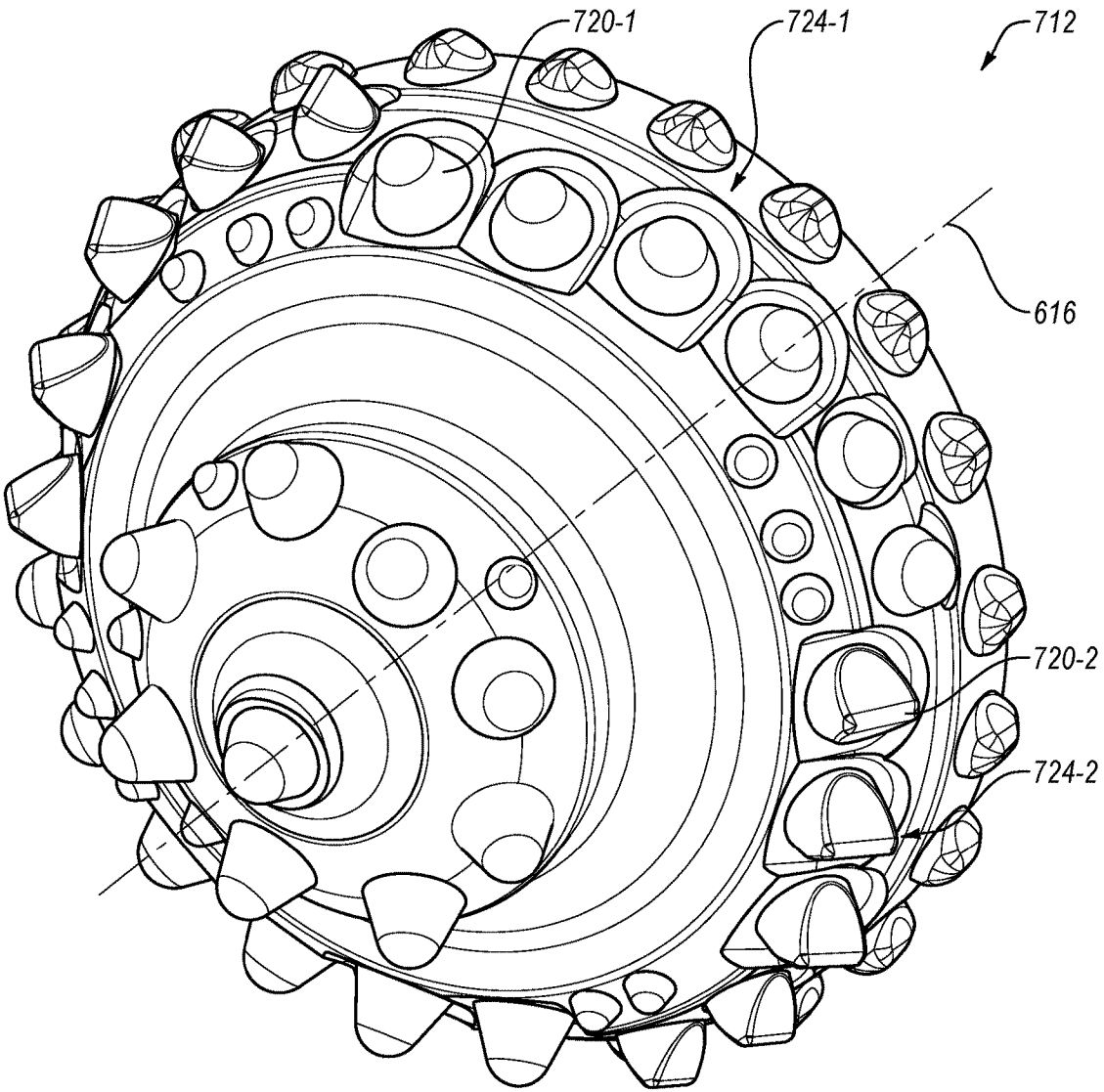
FIG. 8 is a perspective view of another roller cone, according to some embodiments of the present disclosure.

FIG. 8 is a perspective view of another roller cone, according to embodiments of the present disclosure. In some embodiments, a roller cone 712 may include a plurality of sets in an array. For example, the roller cone 712 may include at least a first set 724-1 and a second set 724-2. The first set 724-1 and second set 724-2 may be located at the same longitudinal position relative to the cone axis 716 and displaced around the cone axis 716. In some embodiments, at least one of the cutting elements of the first set 724-1 may be longitudinally aligned (e.g., at the same longitudinal position relative to the cone axis 716) with a cutting element of the second set 724-2. For example, a first cutting element 720-1 located at a leading end of the first set 724-1 may be positioned at the same longitudinal position along the cone axis 716 as a second cutting element 720-2 cutting element located at a leading end of the second set 724-2. While the roller cone 712 rotates about the cone axis 716, the first cutting element 720-1 of the first set 724-1 and second cutting element 720-2 of the second set 724-2 may contact the same location in the composite cutting profile (similar to those described in relation to FIGS. 5 and 6-1) of the roller cone 712.

In some embodiments, the cutting element geometry and/or type may change between the first set 724-1 and second set 724-2, such that the first cutting element 720-1 and second cutting element 720-2, while overlapping in longitudinal position, contact the formation differently. For example, the first cutting element 720-1 may be a conical cutting element and the second cutting element 720-2 may be a chisel cutting element. In other examples, the first cutting element 720-1 may be a chisel cutting element and the second cutting element 720-2 may be a bullet cutting element. In yet other examples, the first cutting element 720-1 may be a frustoconical cutting element and the second cutting element 720-2 may be a conical cutting element. In at least one example, the first cutting element 720-1 may be a conical cutting element and the second cutting element 720-2 may be a conical cutting element with a different radius of curvature at the tip.

In some embodiments, a roller cone bit may include at least one set of cutting elements that vary in extension, type, working material, or radius and may allow increased rate of penetration and/or decreased rate of wear of the cutting elements. In at least one embodiment, the set may be most aggressive at the bottommost point of the composite cutting profile and may be most durable (i.e., most wear-resistant) adjacent the gauge surface.

The embodiments of cutting tools have been primarily described with reference to wellbore cutting operations; the cutting tools described herein may be used in applications other than the drilling of a wellbore. In other embodiments, cutting tools of the present disclosure may be used outside a wellbore or other downhole environment used for the exploration or production of natural resources. For instance, cutting tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification.

Additionally, it should be understood that references to "one embodiment" or "an embodiment" in the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A downhole tool, comprising:

a cone, the cone having an outer surface and a cone axis about which the cone is configured to rotate; and an array positioned on the outer surface of the cone, the array including at least one set of cutting elements within a circumferential band about the cone axis, the at least one set of cutting elements oriented at a non-perpendicular angle to the cone axis, the at least one set including:

a first cutting element positioned at a first longitudinal position and having a first grip; and a second cutting element positioned at a second longitudinal position different from the first longitudinal position and having a second grip, the second grip being different from the first grip.

2. The downhole tool of claim 1, the first cutting element having a first extension and the second cutting element having a second extension, the first extension and the second extension being the same.

3. The downhole tool of claim 1, the array further comprising a third cutting element at a third longitudinal position different from the first longitudinal position and the second longitudinal position, the third cutting element having a third grip that is different from the first grip and the second grip.

4. The downhole tool of claim 3, the third cutting element having a third extension that is the same as at least one of the first extension or the second extension.

5. The downhole tool of claim 1, the first cutting element being at least one of an apexed cutting element or a chisel cutting element.

6. The downhole tool of claim 5, the first cutting element and the second cutting element having different types of cutting element geometry.

7. The downhole tool of claim 1, the first cutting element having a first diameter and the second cutting element having a second diameter, the first diameter and the second diameter being the same.

8. The downhole tool of claim 1, the first cutting element being positioned longitudinally adjacent a gage row, the first grip being less than the second grip.

9. The downhole tool of claim 1, further comprising a third cutting element, the first cutting element being at a first position nearer the cone axis than the second or third cutting elements, the third cutting element being in a last position farther from the cone axis than the second cutting element, and the second cutting element at an intermediate position between the first cutting element and the second cutting element, the first cutting element and the third cutting element having a first cutting element geometry type and the second cutting element having a second cutting element geometry type that is different from the first cutting element geometry type.

10. A downhole tool, comprising:

a body, the body having a bottom end and being rotatable about a longitudinal axis;

a cone connected to the body proximate the bottom end and rotatable relative to the body about a cone axis; and a plurality of cutting elements on the cone, the plurality of cutting elements arranged in a set within a circumferential band about the cone axis, the set of cutting elements oriented at a non-perpendicular angle to the cone axis in which the plurality of cutting elements vary in radial position relative to the cone axis, the set having a first position nearest the cone axis and a last position farthest from the cone axis, a first cutting element being in the first position and a second cutting element being in the last position, where the first cutting element and the second cutting element have a first cutting element geometry type and one or more cutting elements between the first cutting element and the second cutting element have a second cutting element geometry type that is different from the first cutting element geometry type.

11. The downhole tool of claim 10, at least part of the set being positioned at a bottommost portion of the cone or in a staggered zone of the cone adjacent a gauge surface of the cone.

12. The downhole tool of claim 11, each of the plurality of cutting elements of the set decreasing in extension from the bottommost portion toward the gauge surface.

13. The downhole tool of claim 10, the first cutting element and the second cutting element having a cutting tip of a first diameter and each of the one or more cutting elements between the first cutting element and second cutting element having a cutting tip of a second diameter that is less than the first diameter.

14. The downhole tool of claim 10, the first cutting element and the second cutting element having a first extension and at least some of the one or more cutting elements between the first cutting element and second cutting element having a second extension that is different from the first extension.

15. The downhole tool of claim 10, the first cutting element and the second cutting element including a first working material and at least some of the one or more cutting elements between the first cutting element and second cutting element including a second working material that is different from the first working material.

16. The downhole tool of claim 15, the first working material being harder than the second working material.

17. The downhole tool of claim 10, the first cutting element geometry type being a chisel cutting element and the second cutting element geometry type being a conical cutting element.

18. A downhole tool, comprising:

a body having a bottom end and a longitudinal axis about which the body is configured to rotate;

a cone connected to the body proximate the bottom end and rotatable relative to the body about a cone axis of the cone;

a first set of an array positioned on an outer surface of the cone, the first set including a first plurality of cutting elements, at least one of the cutting elements of the first plurality of cutting elements being positioned at a first longitudinal position relative to the cone axis and having a first cutting element geometry type; and a second set of the same array positioned on the outer surface of the cone, the second set including a second plurality of cutting elements, at least one of the cutting elements of the second plurality of cutting elements being positioned at the first longitudinal position relative to the cone axis and having a second cutting element geometry type that is different from the first cutting element geometry type.

19. The downhole tool of claim 18, the first plurality of cutting elements varying in radial position relative to the cone axis and at least one of cutting element extension relative to the outer surface of the cone, cutting element diameter, cutting element grip, or working material of the plurality of first cutting elements, and the second plurality of cutting elements varying in radial position relative to the cone axis and at least one of cutting element extension relative to the outer surface of the cone, cutting element diameter, cutting element grip, or working material of the plurality of second cutting elements.

20. The downhole tool of claim 18, the first cutting element geometry type being at least one of a conical cutting element, a chisel cutting element, or a bullet cutting element, and the second cutting element geometry type being a conical cutting element.

* * * * *